US006520573B2

(12) United States Patent
Österle

(10) Patent No.: US 6,520,573 B2
(45) Date of Patent: Feb. 18, 2003

(54) CHAIR FOR A CABLEWAY SYSTEM

(75) Inventor: Manfred Österle, Sulzberg (AT)

(73) Assignee: Innova Patent GmbH, Wolfurt (AT)

( * ) Notice: Subject to any disclaimer, the term of this patent is extended or adjusted under 35 U.S.C. 154(b) by 0 days.

(21) Appl. No.: 09/817,644

(22) Filed: Mar. 26, 2001

(65) Prior Publication Data

US 2002/0043828 A1 Apr. 18, 2002

(30) Foreign Application Priority Data

Apr. 25, 2000 (AT) ..... 720/2000

(51) Int. Cl.[7] ..... A47C 29/00
(52) U.S. Cl. ..... 297/184.11; 105/149.2
(58) Field of Search ..... 297/184.11, 184.1, 297/184.12, 184.14, 217.7, 469, 487; 105/149.2

(56) References Cited

U.S. PATENT DOCUMENTS 3,008,761 A * 11/1961 McIlvaine ..... 105/149.2 X
3,556,014 A * 1/1971 Rudkin, Jr. ..... 105/149.2 X
3,747,974 A * 7/1973 Tauzin ..... 297/184.1
4,303,016 A * 12/1981 Tauzin ..... 105/149.2 X
4,630,545 A * 12/1986 Michel ..... 297/184.1 X
4,784,065 A * 11/1988 Brochand ..... 105/149.2 X
D307,246 S * 4/1990 Bergius et al. ..... 105/149.2 X
5,213,048 A * 5/1993 Kunczynski ..... 105/149.2
2002/0043829 A1 * 4/2002 Switzeny ..... 297/184.12

* cited by examiner

*Primary Examiner*—Peter M. Cuomo
*Assistant Examiner*—Stephen Vu
(74) *Attorney, Agent, or Firm*—Laurence A. Greenberg; Werner H. Stemer; Ralph E. Locher

(57) ABSTRACT

A chair for a cableway system has a load-bearing framework on which seat surfaces are fastened, a load-bearing bar with a top end at which a clamping apparatus for coupling to a supporting and haulage cable and running rollers are attached. Side panels or the like are disposed at the two lateral ends of the chair. A closure bar and, if appropriate, a covering hood, can be pivoted about spindles which are aligned at least approximately horizontally in the operating position of the chair. The closure bar and/or the covering hood can be pivoted from the open positions into the closed positions counter to the action of at least one adjusting spring. At least one of the side panels or the like is formed with a cavity in which at least one adjusting spring is arranged.

9 Claims, 6 Drawing Sheets

1
4
42
41
11
45
64
43
63
62
21
22
6
44
15
41
61
12
5
51

FIG. 6
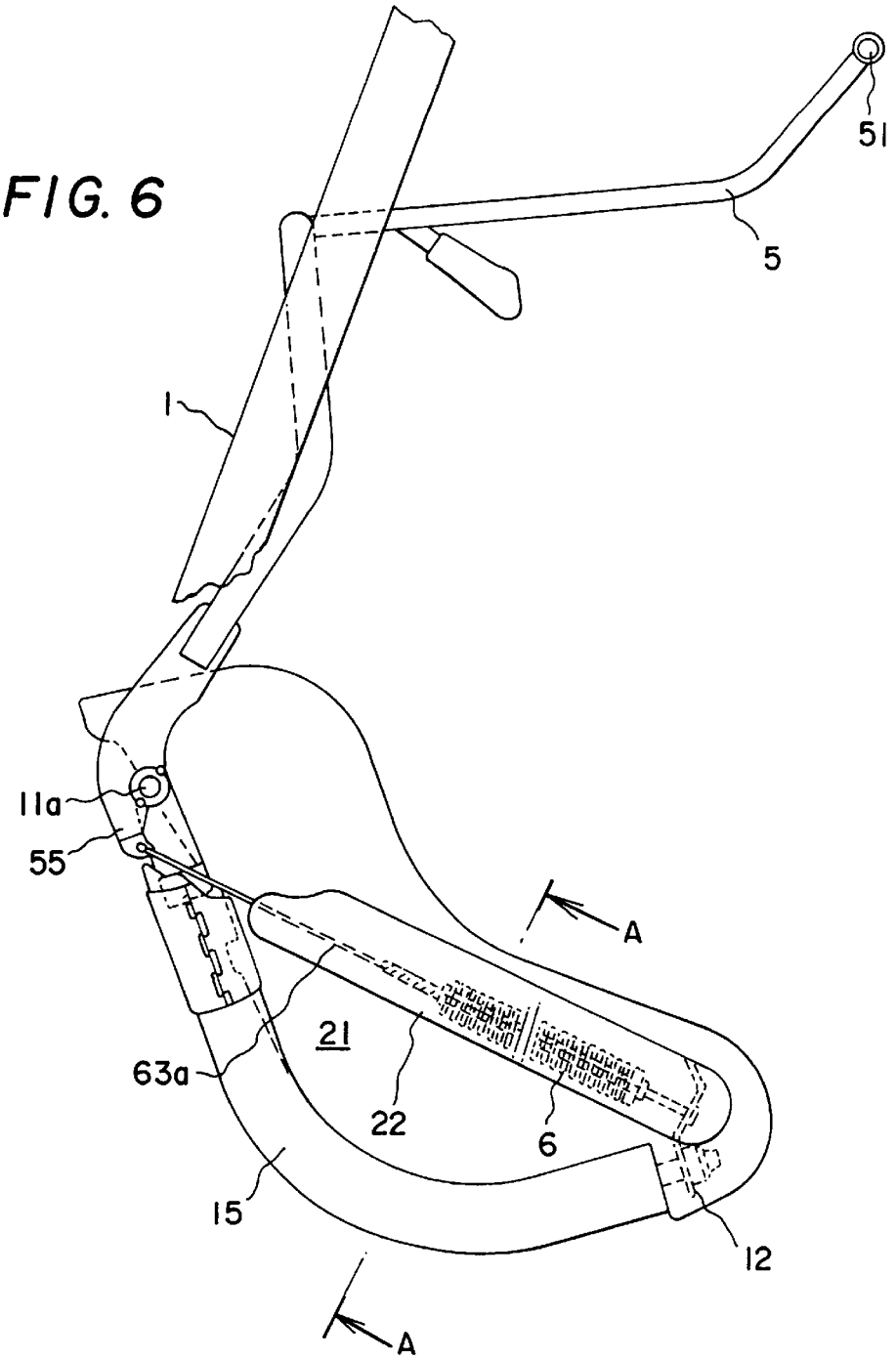
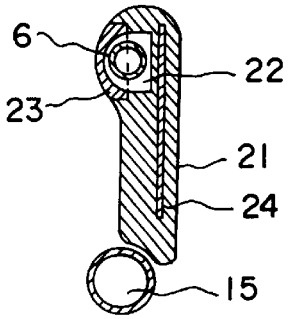
FIG. 6a

CHAIR FOR A CABLEWAY SYSTEM

BACKGROUND OF THE INVENTION

Field of the Invention

The present invention relates to a chair for a cableway system, having a load-bearing framework on which seat surfaces are fastened, having a load-bearing bar which is designed, at its top end, with a clamping apparatus for coupling to a supporting and haulage cable and with running rollers, having side panels or the like arranged at its two lateral ends, having a closure bar and, if appropriate, having a covering hood, both of which can be pivoted about spindles which are aligned at least approximately horizontally in the operating position of the chair, it being possible for the closure bar and/or the covering hood to be pivoted from the open positions into the closed positions counter to the action of at least one biasing spring.

Prior art chairs for cableway systems comprise a load-bearing framework designed with a load-bearing bar, there being provided, at the top end of the load-bearing bar, a clamping apparatus for coupling the chair to a supporting and haulage cable and running rollers, for moving the chair in the stations. Also located on the load-bearing framework are seat surfaces which are assigned to side panels at their two lateral ends. Additionally mounted on the load-bearing framework is a closure bar which can be pivoted from an open position into a closed position and can be pivoted about a spindle which is at least approximately horizontal in the operating position of the chair. Finally, there may also be provided on the load-bearing framework a covering hood, which can likewise be pivoted, about a spindle which is at least approximately horizontal in the operating position of the chair, from an open position into a closed position, in which it encloses the seat surfaces.

It is also known for the closure bar and the covering hood, which may optionally be provided, to be assigned biasing or adjusting springs which assist the pivoting of the bar and covering hood from their open positions into their closed positions and from the closed positions into the open positions, as a result of which the manually operated pivoting of the closure bar and/or of the covering hood is made easier for the user of the chair. In the case of the prior art chairs for cableway systems, the adjusting springs are arranged in an exposed manner on the outside of the chair. This, however, involves the disadvantages that the adjusting springs are exposed to the effects of the weather, that, in addition, measures have to be taken in order for it to be possible to rule out injury to the passengers by the adjusting springs, and that measures additionally have to be taken when the chairs are garaged, in order for it to be possible to rule out damage to the chairs when they are disposed one behind the other.

SUMMARY OF THE INVENTION

It is accordingly an object of the invention to provide a lift chair for a cableway system, which overcomes the above-mentioned disadvantages of the heretofore-known devices and methods of this general type and which avoids the disadvantages to which the prior art is exposed by the arrangement of the adjusting springs.

With the foregoing and other objects in view there is provided, in accordance with the invention, a chair for a cableway system, comprising:

- a load-bearing framework having lateral ends, and a plurality of seat surfaces fastened to the load-bearing framework, and a load-bearing bar having an upper end;

- a clamping apparatus for coupling to a supporting and haulage cable and running rollers mounted to the upper end of the load-bearing bar;
- side panels at the lateral ends of the load-bearing framework;
- a closure device (e.g., closure bar and/or covering hood) pivotally mounted on the load-bearing framework about a substantially horizontal axis, in an operating position of the chair, between an open position and a closed position;
- at least one of the side panels having a cavity formed therein; and
- at least one biasing spring disposed in the cavity and being connected between the load-bearing framework and the closure device for counteracting a closure of the closure device from the open position into the closed position.

In other words, the objects of the invention are achieved in that at least one of the side panels or the like is designed with a cavity in which the at least one adjusting spring is arranged, the adjusting spring being articulated, on the one hand, on the load-bearing framework and, on the other hand, on the closure device, i.e., on the closure bar and/or on the covering hood.

In accordance with an added feature of the invention, the closure device is a closure bar, and a covering hood is further pivotally mounted on the load-bearing framework about the substantially horizontal axis between an open position and a closed position, and wherein the biasing spring is articulated on the load-bearing framework and on the covering hood for counteracting a closure of the covering hood from the open position into the closed position.

In accordance with an additional feature of the invention, the closure device is a covering hood pivotally mounted on the load-bearing framework, and the biasing spring is articulated on the load-bearing framework and on the covering hood for counteracting a closure of the covering hood from the open position into the closed position.

In accordance with another feature of the invention, the biasing spring, also referred to as an adjusting spring, is a tension spring.

In accordance with again another feature of the invention, the covering hood is formed with a carrying frame and one end of the biasing spring is articulated on the carrying frame.

In accordance with a further feature of the invention, the carrying frame and/or the closure bar is formed with extensions mounting the covering hood and/or closure bar on approximately horizontally aligned journals. In that case, one end of the tension spring is articulated on the extensions.

In accordance with again an additional feature of the invention, a tension element, i.e., a tie element, is connected between the biasing spring and the carrying frame, or between the biasing spring and the closure bar.

In accordance with a concomitant feature of the invention, there is provided a removable cover closing off the cavity towards an outside of the panel.

Other features which are considered as characteristic for the invention are set forth in the appended claims.

Although the invention is illustrated and described herein as embodied in a chair for a cableway system, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE DRAWINGS

FIG. 6 is a similar view of the chair shown in FIG. 5, with the closure bar in the open position; and FIG. 6*a* is a sectional view taken along the lines A—A in FIGS. 4 and 6 and viewed in the direction of the arrows.

DESCRIPTION OF THE PREFERRED EMBODIMENTS

Figure 1:
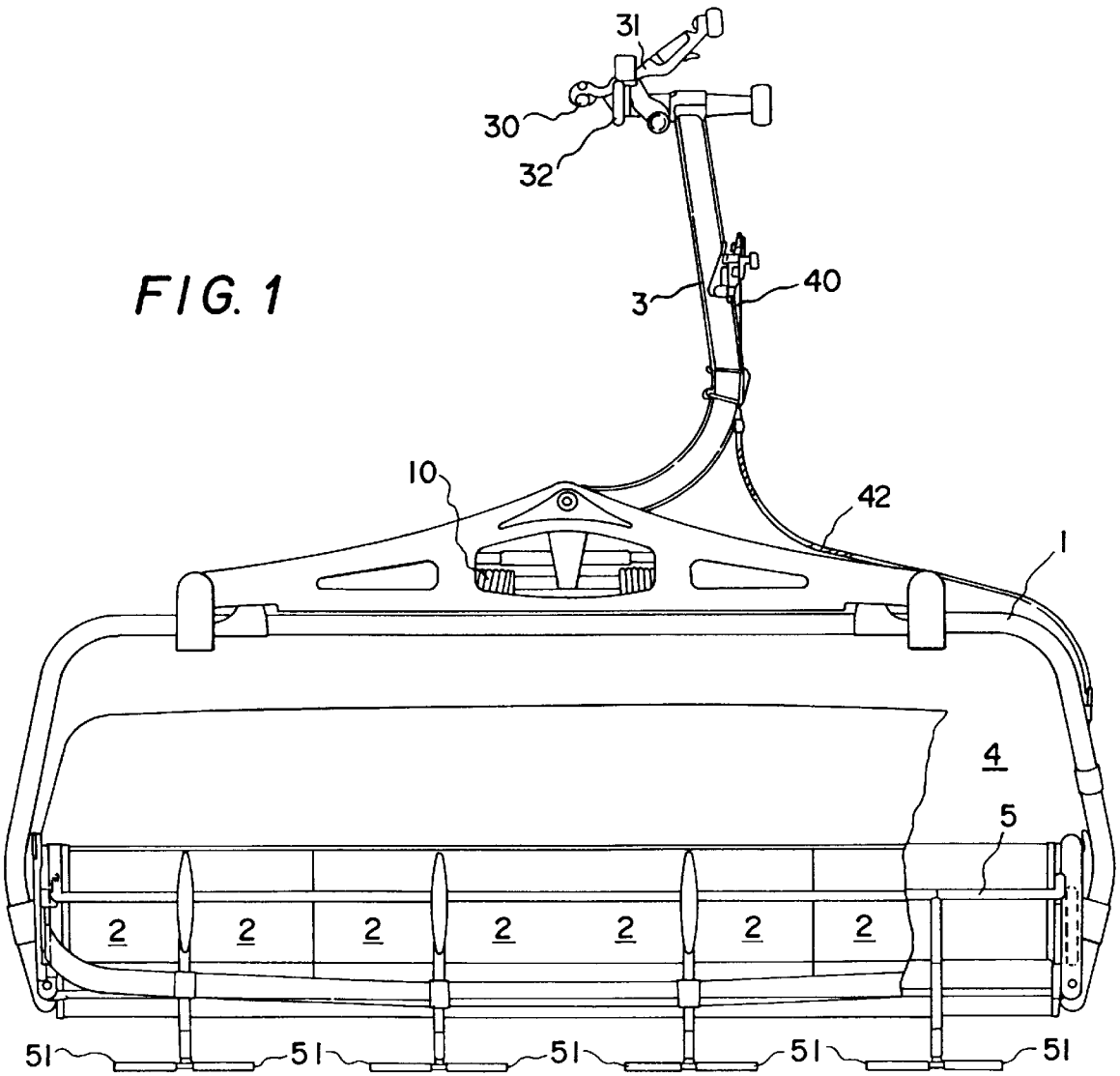
FIG. 1 is a front elevational view of a first exemplary embodiment of a chair according to the invention.

Referring now to the figures of the drawing in detail and first, particularly, to FIG. 1 thereof, there is shown lift chair for a cableway system. The chair comprises a load-bearing framework 1 for eight seat surfaces 2. Projecting upward from the load-bearing framework 1 is a load-bearing bar 3, at the top end of which there is provided a clamping apparatus 31 by means of which the chair can be coupled to a supporting and haulage cable 30. Also provided is a running-gear mechanism 32 by means of which the chair can be moved along rails in the stations, where it has been uncoupled from the supporting and haulage cable 30. The chair is also designed with a covering hood 4 which can be pivoted, about a substantially horizontal spindle, from a closed position, in which it encloses the seat surfaces 2, into an open position. The chair is additionally provided with a closure bar 5, which can likewise be pivoted, about a substantially horizontal spindle, from its open position into its operating position. The closure bar 5 is designed with a number of footrests 51 which corresponds to the number of seat surfaces 2.

The covering hood 4 is assigned a setting device 40, or adjusting assembly, which can control the pivoting of the covering hood 4 by means of a Bowden cable 42. A damping assembly 10 is provided between the load-bearing framework 1 and the load-bearing bar 3.

In the satations of the cableway systems, the covering hood 4 and the closure bar 5 are pivoted into their open position, as a result of which the passengers can embark and sit on the seat surfaces 2 or disembark and leave the same. The closure bar 5 is then pivoted into its operating position. The covering hood 4 can be pivoted into the closed position either automatically by means of the setting device 40 or manually by the passengers.

Figure 2:
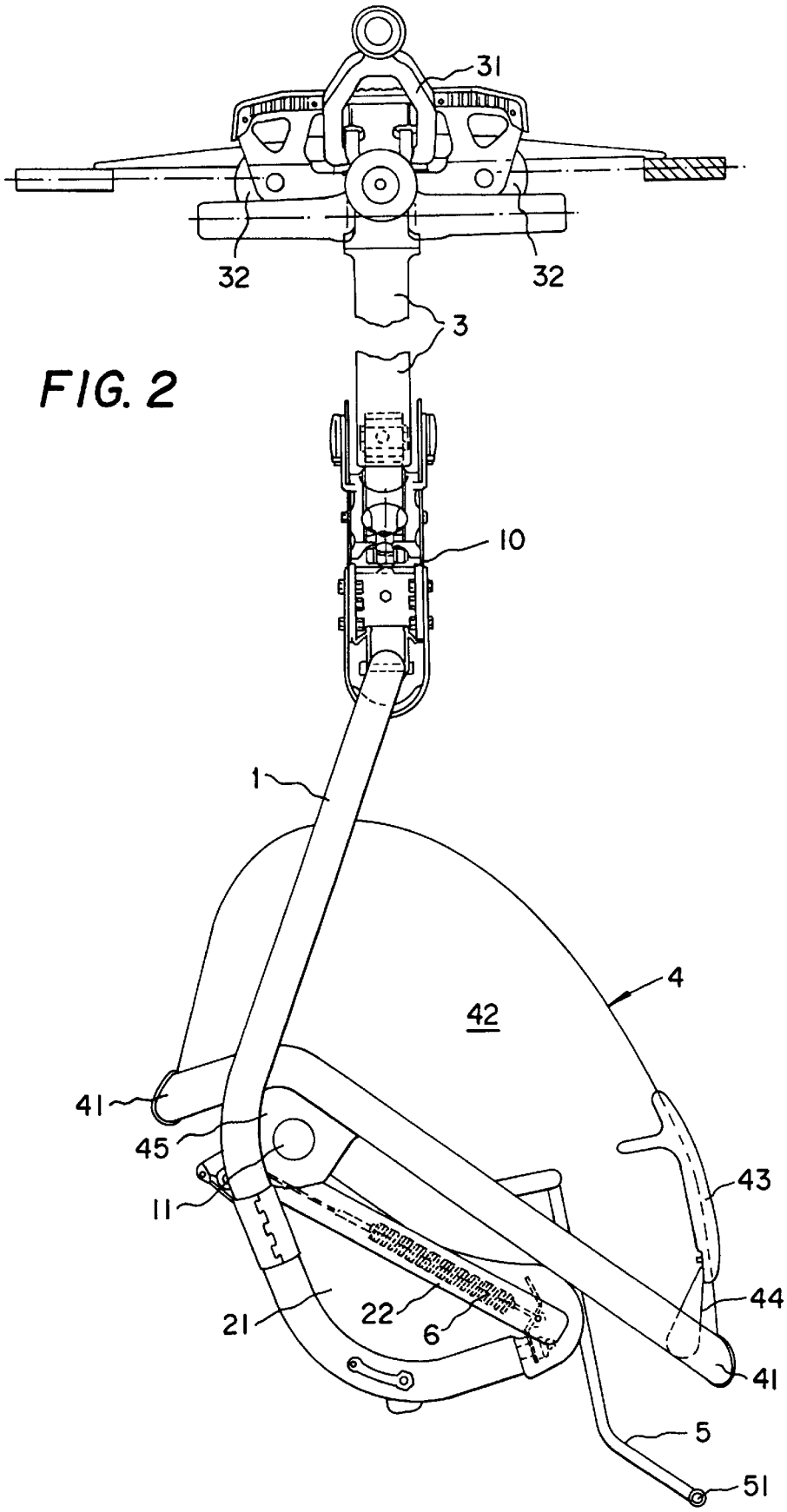
FIG. 2 is a side view, and on a larger scale, of the chair shown in FIG. 1.

With reference to FIG. 2, the covering hood 4 is formed with a carrying frame 41 on which there is fastened a hood 4, which is produced from transparent material and is of convexly curved design. On its front side, the covering hood 4 is provided with a plurality of buffer elements 43, which prevent the hood 4 from being damaged by chairs located alongside the same.

As can also be seen from FIG. 2, the carrying frame 41 is designed with two extensions 45 by means of which the covering hood 4 is mounted pivotably on bearing journals 11 of the load-bearing framework 1, as a result of which it can be pivoted from the closed position, in which it encloses the seat surfaces 2, into the open position. For this purpose, the covering hood 4 is designed with a plurality of straps 44 which the passengers can grip in order to pivot the covering hood 4 from the open position into the closed position. In order to assist and/or facilitate this pivoting, recesses 22 are provided in the side panels 21 located on both sides of the seat surfaces 2, said recesses containing adjusting springs 6 which are articulated on the covering hood 4 and interact therewith.

Figure 3:
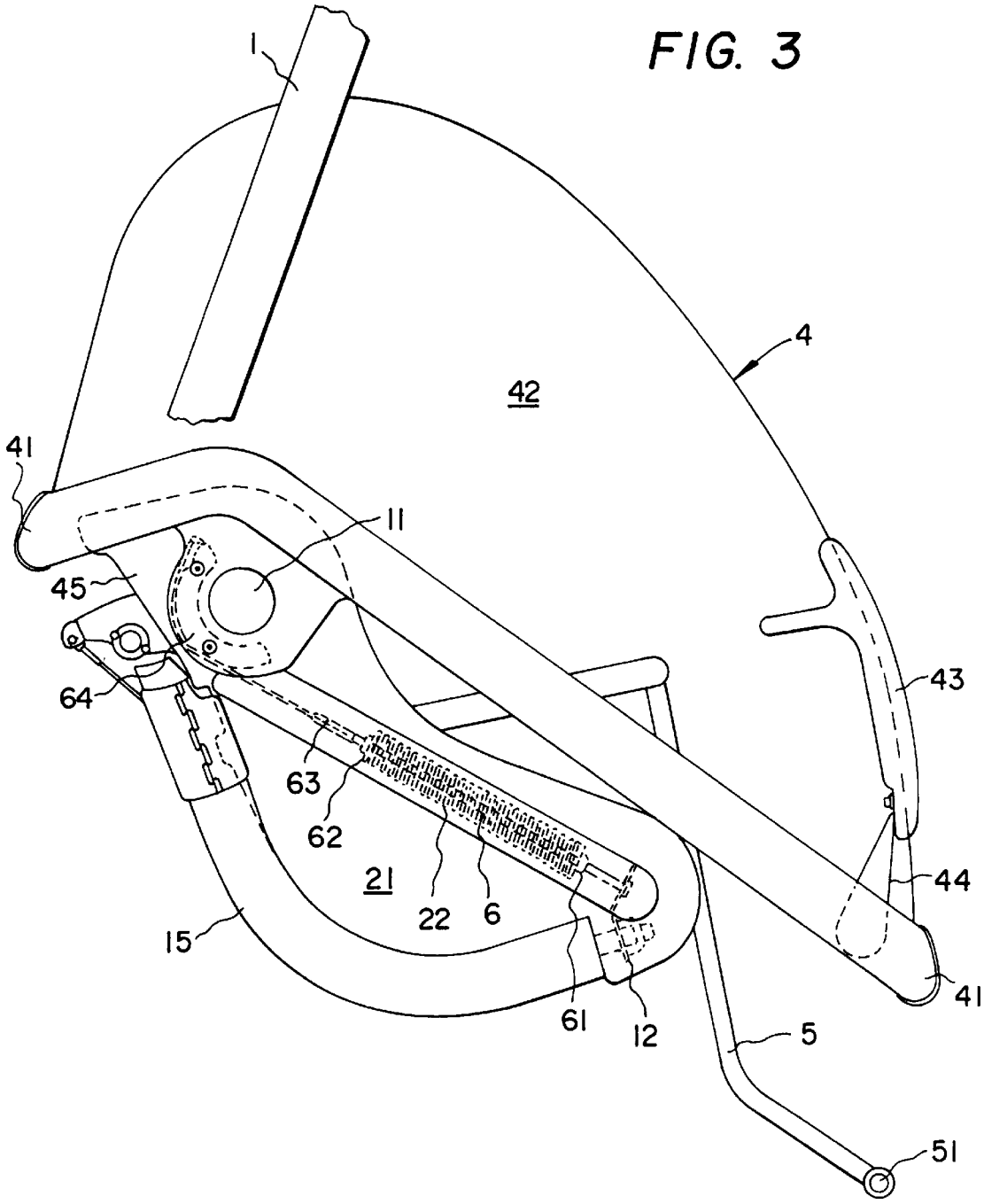
FIG. 3 is a partial side view of the chair of FIG. 2, on a larger scale than FIG. 2, and with the covering hood in the closed position.

Referring now to FIG. 3, the two lateral ends of the load-bearing framework 1 are designed as curved brackets 15, at the free front ends of which there are fastened brackets 12 which project into the recesses 22 and on which in each case a first end 61 of the tension springs 6 is fastened. Articulated on the second end 62 of the tension spring 6 in each case is a tie element 63 which is fastened on the extensions 45 provided on the carrying frame 41, the tie element being guided in each case in a rail 64 arranged on the extension 45.

Figure 4:
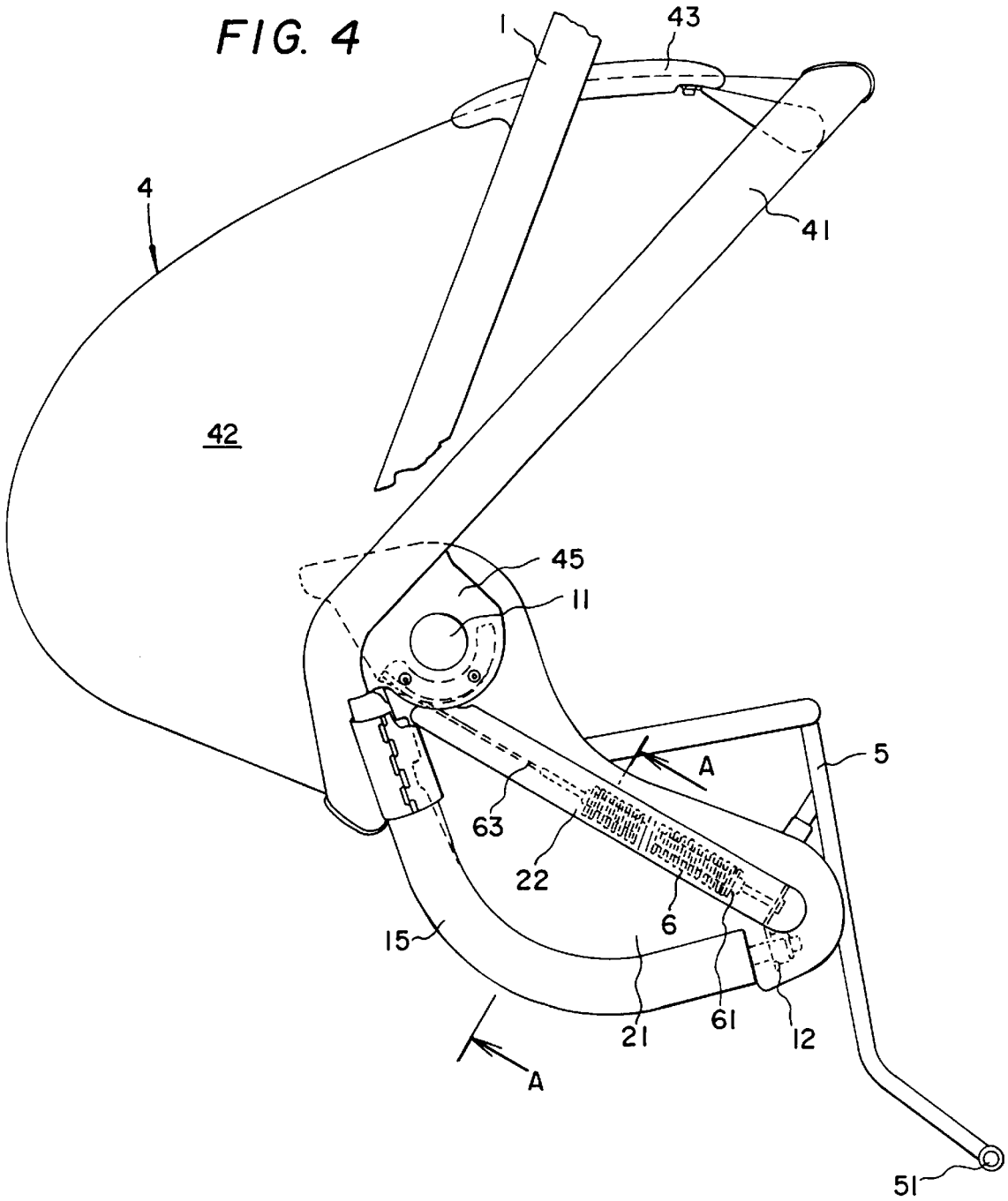
FIG. 4 is a partial side view of the chair of FIG. 3, with the covering hood in the open position.

In FIG. 3, the covering hood 4 is illustrated in its closed position. In FIG. 4, in contrast, the covering hood 4 is illustrated in its open position. The pivoting of the covering hood 4 from the closed position into the open position is assisted by the tension springs 6 located in the two side panels 21.

Figure 5:
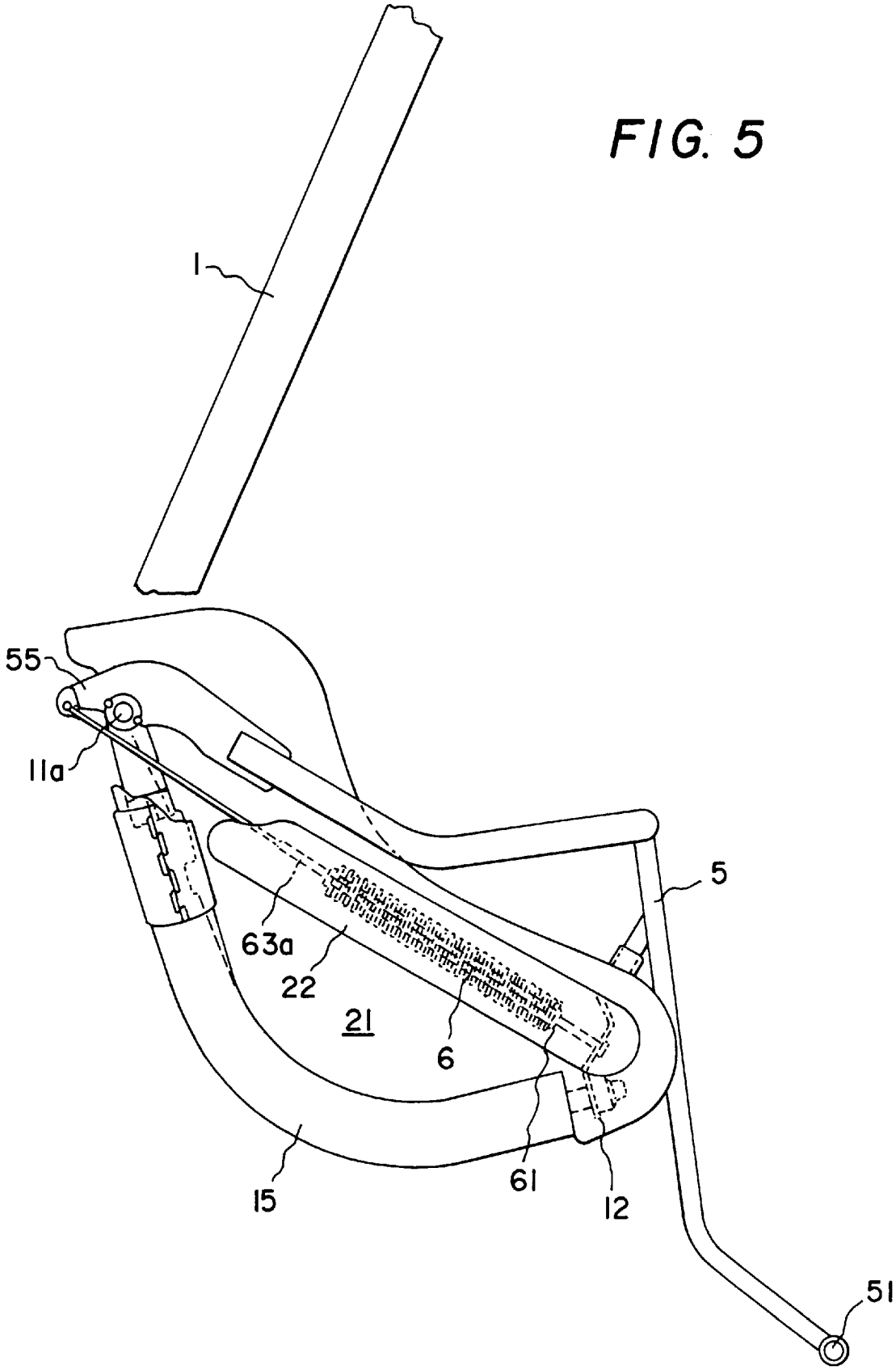
FIG. 5 is a partial side view of a second exemplary embodiment of the chair according to the invention, with the closure bar in the closed position.

Referring now to FIG. 5, in a second embodiment, the closure bar 5, which is mounted such that it can be pivoted about approximately horizontal journals 11*a*, is designed with continuations 55, on which there are articulated tie rods 63*a* which are connected to the tension springs 6. The tension springs 6 assist the pivoting of the closure bar 5 from the closed position into the open position.

In FIG. 5, the closure bar 5 is illustrated in its closed position and, in FIG. 6, the closure bar 5 is illustrated in its open position.

In this embodiment too, the tension springs 6 are arranged in recesses 22, said recesses 22 likewise being accessible by way of removable coverings 23.

With reference to FIG. 6*a*, the lateral panels 21 are located above the curved brackets 15. The side panels 21 contain the recesses 22, within which the tension springs 6 are arranged. In addition, the recesses 22 are assigned, on their outsides, coverings 23 which are fastened in a releasable manner. Once said coverings 23 have been removed, the tension springs 6 are accessible for maintenance and/or for replacement. The side panels 21, which are preferably produced from a plastic material, are designed with reinforcements 24 produced from metal.

It should additionally be pointed out that the chair may be designed with a pivotable closure bar and, in addition, also with a pivotable covering hood, in which case either the closure bar or the covering hood is assigned, or both the closure bar and the covering hood are assigned, at least one tension spring to assist the pivoting movements thereof. It is critical for the present invention that the at least one adjusting spring is arranged in a cavity which is located in one or both side panels of the chair, as a result of which the disadvantages of the prior art chairs which are caused by the arrangement of the adjusting springs are avoided.

I claim:

1. A chair for a cableway system, comprising:

a load-bearing framework having lateral ends, and a plurality of seat surfaces fastened to said load-bearing framework, and a load-bearing bar having an upper end;

a clamping apparatus for coupling to a supporting and haulage cable and running rollers mounted to said upper end of said load-bearing bar;

side panels at said lateral ends of said load-bearing framework;

a closure device pivotally mounted on said load-bearing framework about a substantially horizontal axis, in an operating position of the chair, between an open position and a closed position;

at least one of said side panels having a cavity formed therein; and at least one biasing spring disposed in said cavity and being connected between said load-bearing framework and said closure device for counteracting a closure of said closure device from the open position into the closed position.

2. The chair according to claim 1, wherein said closure device is a closure bar, and a covering hood is further pivotally mounted on said load-bearing framework about the substantially horizontal axis between an open position and a closed position, and wherein said biasing spring is articulated on said load-bearing framework and on said covering hood for counteracting a closure of said covering hood from the open position into the closed position.

3. The chair according to claim 2, wherein said covering hood is formed with a carrying frame and one end of said biasing spring is articulated on said carrying frame, at least one of said carrying frame and said closure bar is formed with extensions mounting at least one of said covering hood and closure bar on approximately horizontally aligned journals and having said tension spring articulated on one end thereof.

4. The chair according to claim 1, wherein said closure device is a covering hood.

5. The chair according to claim 4, wherein said covering hood is formed with a carrying frame and one end of said biasing spring is articulated on said carrying frame.

6. The chair according to claim 5, which comprises a tension element connected between said biasing spring and said carrying frame.

7. The chair according to claim 5, which comprises a tension element connected between said biasing spring and said closure bar.

8. The chair according to claim 1, wherein said biasing spring is a tension spring.

9. The chair according to claim 1, which comprises a removable cover closing off said cavity towards an outside of said panel.

* * * * *